United States Patent [19]

Heinis et al.

[11] 4,415,270

[45] Nov. 15, 1983

[54] PAINT MIXER CONTAINER CLAMPING DEVICE WITH INERTIALLY DRIVEN CAN ROTATING FUNCTION

[75] Inventors: Robert P. Heinis, Totowa Boro; Eric Vass, Clark, both of N.J.

[73] Assignee: Red Devil Inc., Union, N.J.

[21] Appl. No.: 434,741

[22] Filed: Oct. 18, 1982

[51] Int. Cl.[3] ..... B01F 11/00

[52] U.S. Cl. ..... 366/216; 366/605; 74/126

[58] Field of Search ..... 74/126, 142; 192/45, 192/46; 366/197, 198, 208, 209, 210, 211, 213, 214, 216, 217, 218, 219, 220, 232, 233, 237, 605

[56] References Cited

U.S. PATENT DOCUMENTS 2,109,233 2/1938 Jorgenson ..... 366/209

3,181,841 5/1965 Boehm ..... 366/217 X 4,175,484 11/1979 Tobey ..... 192/46

4,266,642 5/1981 Mazzorama ..... 192/45

*Primary Examiner*—Robert W. Jenkins

*Assistant Examiner*—Arthur D. Dahlberg

*Attorney, Agent, or Firm*—Albert F. Kronman

[57] ABSTRACT

A device for mixing paint and similar thick liquids within a container in which the container is held between the jaws of a clamp and rocked back and forth by a source of power. The clamp jaws are freely mounted so that they can rotate with the container about its longitudinal axis. An inertially driven mechanism which is independent of the rocking power source serves to rotate the container about its longitudinal axis as it is rocked, thereby greatly reducing the time required to thoroughly mix the paint within the container.

9 Claims, 4 Drawing Figures

PAINT MIXER CONTAINER CLAMPING DEVICE WITH INERTIALLY DRIVEN CAN ROTATING FUNCTION

BACKGROUND OF THE INVENTION

It is well-known to mix paint and other thick or viscous liquids as well as certain powders without removing them from their containers. Paint mixers for this purpose, in one form, grasp the container between jaws at the top and bottom of the container and rock them rapidly about their longitudinal axes through a short arc. Another form of paint mixer tumbles the container about its transverse axis. Power from the tumbling power source is employed over a series of pulleys, belts or other mechanism to impart a rotating motion to the container as it tumbles.

It is an object of the present invention to decrease the amount of time required to mix the contents within a container being rocked about its longitudinal axis by simultaneously rotating it about said axis.

Another object of the present invention is to impart rotary motion to a container being rocked without coupling it to the power source.

A further object of the present invention is to provide a simple, trouble free, mechanism for rotating a container while it is being rocked in a mixing machine.

SUMMARY

In one embodiment of the present invention a power source coupled to a container clamp rocks a container held between the clamp jaws through an arc of the order of 30°. The clamp jaws are freely mounted upon stub shafts in line with the longitudinal axis of the container. An inertial drive carried by the clamping mechanism and including a one-way clutch, causes the container to rotate as it is being rocked by the power source.

BRIEF DESCRIPTION OF THE DRAWINGS

In the accompanying drawings forming part hereof, identical parts have been given the same reference numerals, in which drawings.

Referring to the drawings, FIGS. 1 and 2 show a paint mixer can clamping device 10 secured to the output shaft 11 of an oscillating power source (not shown). Any securing device such as the "U" bolt 12 is suitable for this purpose.

Figure 1:
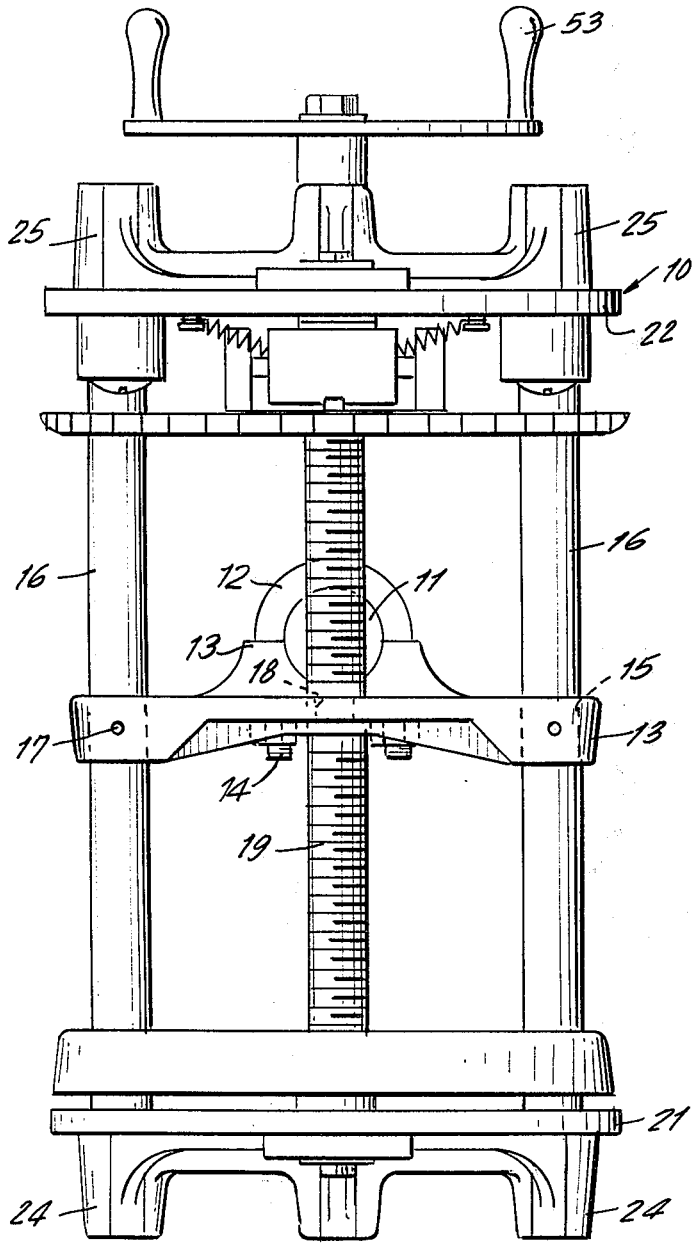
FIG. 1 is a front plan view of a paint mixer can clamping device in accordance with the present invention.
Figure 2:
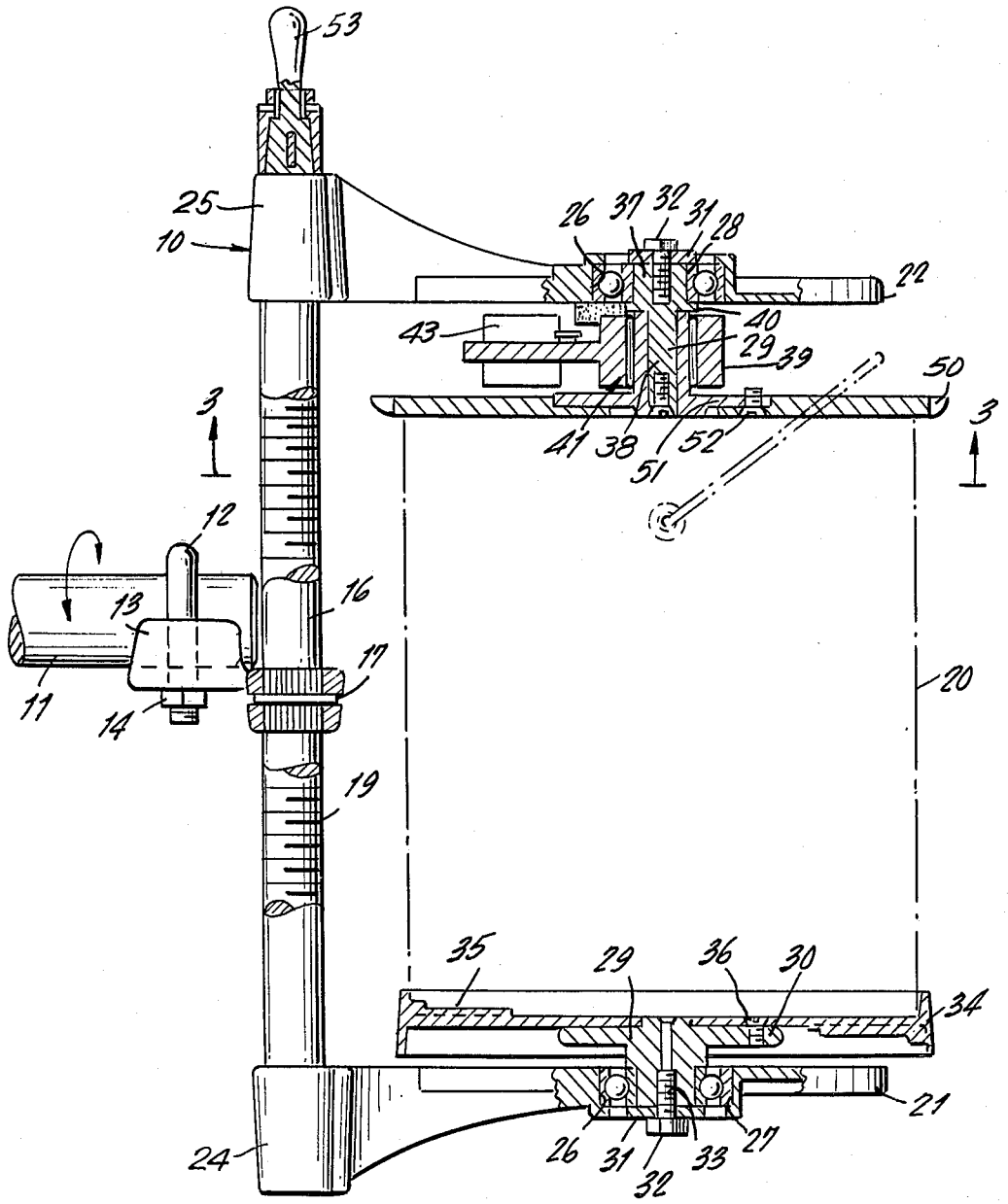
FIG. 2 is a side view partly in section and partly broken away of the device shown in FIG. 1.

The "U" bolt 12 is bolted to a plate-like adaptor 13 as indicated at 14 in FIGS. 1 and 2. The adaptor 13 is provided at its outer ends with transverse bores 15 to receive therethrough upstanding, elongated guide rods 16 (as shown in FIG. 1). The guide rods 16 are secured to the adaptor 13 by means of roll pins 17. A third bore 18 is provided at the center of the adaptor 13 to freely receive an adjusting screw 19, as hereinafter more fully described.

By reason of the location of the adaptor 13 with respect to the vertical guide rods 16 the can clamping device is located upon the desired axis of oscillation, which is above the transverse horizontal axis of the container 20 (indicated in dashed lines in FIG. 2).

A bottom jaw 21 and a top jaw 22 comprise part of the container grasping portion of the present invention. The jaws 21, 22 are somewhat disc shaped and formed with flanged portions 23 having vertically disposed sleeve bearings 24, 25 therefor (See FIG. 3). The sleeve bearings are freely received upon the guide rods 16. Each of the jaws 21, 22 is centrally bored as shown at 26 to receive a ball bearing 27, 28 press fitted therein.

A two diameter support hub 29 having a flanged portion 30 adjacent the upper end thereof is press fitted within the inner race of the ball bearing 27 for free rotation with said race. The support hub is held in place by a washer 31 and an elongated bolt 32 which is disposed within an axial threaded bore 33 in the support hub 29.

A container support plate 34 completes the bottom jaw assembly. The support plate may be made of some suitable plastic such as vinyl acetate, methyl methacrylate or the like which is relatively stiff but will nevertheless flex to accommodate slightly misshapen container ends. In addition, the support plate 34 may be internally stepped as shown at 35 in FIG. 2 to receive containers of different diameter sizes without need for changing support plates. The support plate 34 is secured to the top of the flanged portion 30 by flat head screws 36.

The upper jaw 22 ball bearing 28 is provided with a two-diameter support hub 29 in which the larger diameter 37 is press fitted into the inner race of the roller bearing 28. The smaller diameter 38 is of a size to receive a one way drive or clutch mechanism 39, hereinafter more fully described. The support hub 29 is secured in place by a washer 31, a flanged portion 40, and a bolt 32 threaded into an internal bore 33 in said hub so that the upper jaw can rotate freely about its longitudinal axis.

Figure 3:
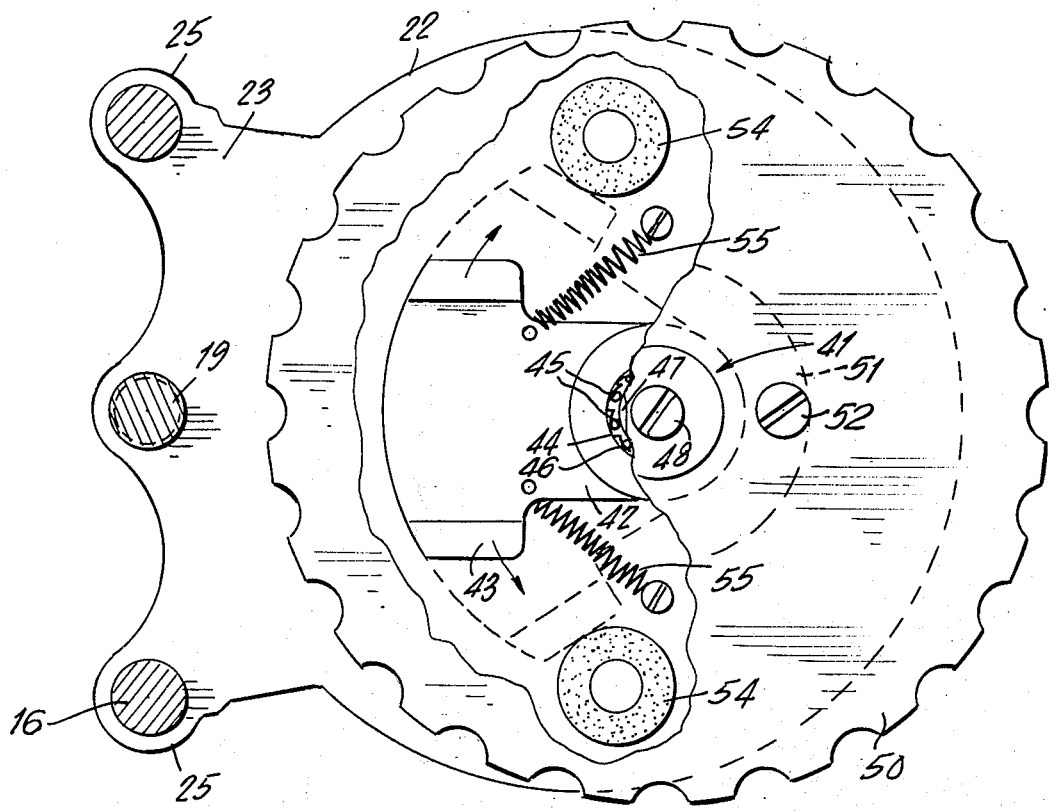
FIG. 3 is a sectional view taken on line 3—3 in FIG. 2, with certain parts broken away, somewhat enlarged.

An inertial drive mechanism 41 best shown in FIGS. 2 and 3 is operatively coupled to the reduced portion of the two-diameter support hub 29. The inertial drive mechanism consists of a short lever 42 having a weight 43 formed on its outer or free end and a transverse bore 44 at its inner end. A plurality of elongated recesses 45 are provided in the wall of the bore 44. The recesses have inclined arcuate surfaces to freely receive a series of pin bearings 46 to form, with a roller hub 47, a one-way roller clutch, well-known in the clutch art. A flat headed screw 48 secures the roller hub 47 to the bottom or free end 49 of the support hub 29.

The top of the container 20 is engaged by a dlamp plate 50 fastened to an enlarged flange 51 on the roller hub 47 by flat head screws 52.

Figure 4:
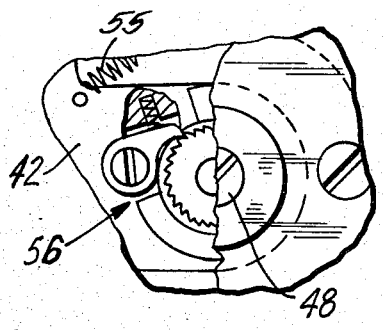
FIG. 4 is a fragmentary top view of another form of inertial drive useful in the present invention.

An inertially driven ratchet mechanism **5*b* shown in FIG. 4 may be used instead of the clutch of FIGS. 1–3**.

After the container 20 has been placed upon the support plate 34 the jaws 21, 22 are moved toward each other by means of a handle 53 on the adjusting screw 19. The adjusting screw 19, best showing in FIG. 1 is journaled in the bore 18 in the adaptor 13. One portion of the adjusting screw 19, as for example the portion above the bore 18, is provided with a right handed thread. The other portion, below the bore 18, has a left hand thread. Since the bottom and upper jaws 21, 22 are transversely bored and threaded to receive the adjusting screw, as shown in FIG. 3, the jaws 21, 22 will move toward or away from each other depending upon the direction of turn of the handle 53. In this manner the container is grasped or released by the jaws without changing the proper location of the container on the axis of oscillation.

From the foregoing the operation of the container clamping device will be understood to be as follows:

With the container 20 clamped between the jaws 21, 22 in the manner indicated in FIG. 2, the source of oscillating power is energized. The container will be rocked through an arc of the odrder of 30°, that is 15° on each side of the perpendicular. As the container starts its oscillation, the weight 43 of the lever 42, due to its mass, resists movement. The container clamp thus precedes the weighted arc of the lever 42. Upon reversal of the can clamp, it will be observed that the lever 42 is still proceding toward a stop member 54 secured to the jaw 23 and despite the pull of one of two snubber springs 55 thereby activating the one-way clutch. As the cycle is repeated the weighted lever 42 will oscillate at the same frequency as the clamp but slightly behind it in time. Since the lever 42 is coupled to the roller clutch hub 47 by the one-way clutch, an incremental rotational force is applied to the clutch hub. This rotational force drives the clamp plate 50 and thus the container 20, rotating it upon its longitudinal or vertical axis to supply an additional movement; i.e. rotational, to the container as it is being oscillated.

What is claimed is:

1. A container clamping and rotating apparatus for a liquid mixing machine having an oscillating power output source comprising a clamp coupled to the oscillating power source, spaced container grasping jaws on said clamp, a first and a second container support plate freely journaled on the spaced jaws, inertial drive means carried by the clamp and operatively coupled to at least one of the container support plates to rotate the container within the jaws as the clamp is being oscillated and means to move the jaws toward and away from each other to grasp and release the container.

2. Apparatus according to claim 1 in which the clamp is coupled to the oscillating power source by a plate-like adaptor having spaced transverse bores therein, an elongated guide rod received in each of the transverse bores and secured to the adaptor intermediate the free ends of the guide rods, and spaced transverse bores in each of the jaws to slidably receive the free ends of the guide rods.

3. Apparatus according to claim 2 in which the adaptor is formed with a transverse bore between the spaced transverse bores therein, an elongated adjusting screw is freely received within the said bore, said adjusting screw having a right hand thread for a portion of its length on one side of the adaptor and a left hand thread for a portion of its length on the other side of the adaptor.

4. Apparatus according to claim 3 in which the container grasping jaws are transversely bored and threaded to receive the left and right hand threaded portions of the adjusting screw and handle means are carried by the said adjusting screw to control the position of the container grasping jaws.

5. Apparatus according to claim 1 in which the inertial drive means is a one-way clutch.

6. Apparatus according to claim 5 in which the one-way clutch is driven by a lever coupled to the clutch and a weighted portion at the free end of said lever responsive to the oscillation of the clamp.

7. Apparatus according to claim 6 in which the inertial drive means lever is formed with a transverse bore opposite the weighted portion, said transverse bore being received upon a hub carried by one of the jaws, and a plurality of pin bearings between the transverse bore and the hub, forming a one-way clutch mechanism.

8. Apparatus according to claim 1 in which the inertial drive means is a ratchet mechanism driven by a lever coupled to the clutch, said lever having a weighted portion at the free end thereof.

9. Apparatus according to claim 1 in which the first and second container support plates are coupled to said jaws by a hub freely carried by a bearing in each of said container supports, and the inertial drive means is coupled to at least one of said hubs.

* * * * *